US007128630B2

(12) United States Patent
Geier et al.

(10) Patent No.: US 7,128,630 B2
(45) Date of Patent: Oct. 31, 2006

(54) METHOD FOR MANUFACTURING A SPARK PLUG WITH GLAZE COATING

(75) Inventors: Heinz Geier, Leonberg (DE); Rudolf Pollner, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/147,585

(22) Filed: Jun. 7, 2005

(65) Prior Publication Data

US 2005/0227567 A1 Oct. 13, 2005

Related U.S. Application Data

(62) Division of application No. 10/463,975, filed on Jun. 17, 2003, now Pat. No. 6,922,007.

(30) Foreign Application Priority Data

Jun. 29, 2002 (DE) ..... 102 29 338

(51) Int. Cl.
*H01T 21/02* (2006.01)

(52) U.S. Cl. ..... 445/7; 313/118; 313/143

(58) Field of Classification Search ..... 313/118, 313/141, 143; 445/7
See application file for complete search history.

(56) References Cited

U.S. PATENT DOCUMENTS

| | | | | |
|---|---|---|---|---|
| 5,859,491 | A | 1/1999 | Nishikawa et al. | 313/141 |
| 6,492,289 | B1 * | 12/2002 | Suzuki et al. | 501/14 |
| 6,566,792 | B1 | 5/2003 | Nishikawa | 313/118 |
| 6,752,677 | B1 | 6/2004 | Nishikawa et al. | 445/7 |

FOREIGN PATENT DOCUMENTS

| | | |
|---|---|---|
| EP | 788 204 | 8/1997 |
| EP | 1 168 546 | 1/2002 |

* cited by examiner

*Primary Examiner*—Mariceli Santiago
*Assistant Examiner*—Kevin Quarterman
(74) *Attorney, Agent, or Firm*—Kenyon & Kenyon LLP

(57) ABSTRACT

A spark plug includes a ceramic component, whose surface is at least in part coated with a glaze, with the glaze containing 0.6% to 4% by weight of fluoride and 6% to 11.2% by weight of zinc oxide.

3 Claims, 1 Drawing Sheet

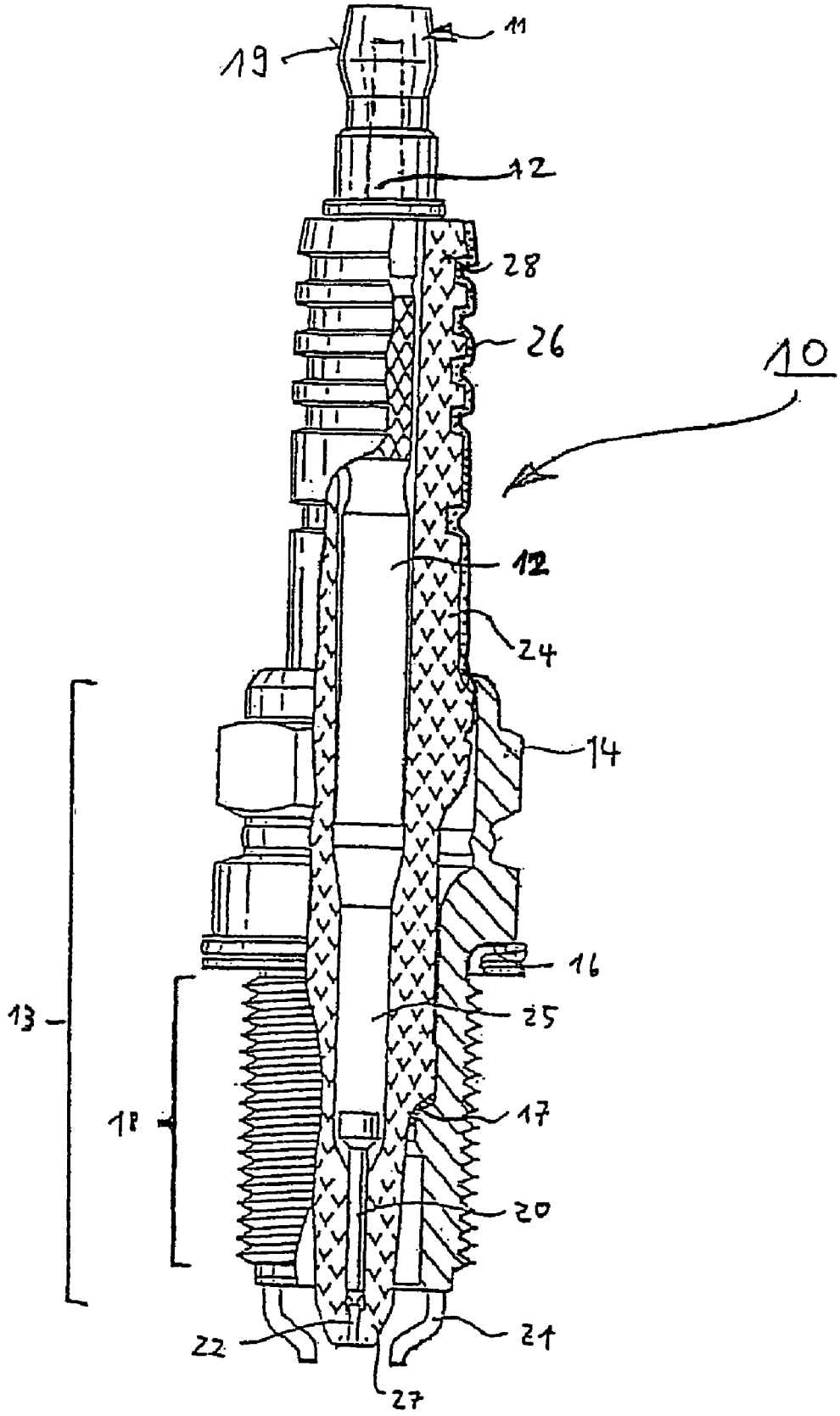
19
11
12
28
26
10
12
24
14
16
13
25
18
17
20
22
21
27

METHOD FOR MANUFACTURING A SPARK PLUG WITH GLAZE COATING

This application is a division of prior application U.S. Ser. No. 10/463,975 filed Jun. 17, 2003 now U.S. Pat. No. 6,922,007.

FIELD OF THE INVENTION

The present invention relates to a spark plug, and a method for its manufacture.

BACKGROUND INFORMATION

Glazing for the protection of ceramic surfaces is a common practice. Among other things, glazes are used on insulators for spark plugs, in which an appropriate glaze serves to protect the insulation ceramics against environmental effects and render its surface smooth and visually pleasing. In the past, glazes containing lead were used for this purpose; as a result of new developments, however, the use of lead is avoided for reasons of environmental protection.

Such lead-free glazes are, for example, known from European Patent Application No. 788 204, where the glazes are implemented on the basis of borosilicate glasses and contain, at most, only a small amount of lead. In addition, they may contain a fluoride in the form of sodium fluoride or aluminum fluoride.

The criteria important for good processing characteristics of a glaze include its melting point and the stability of the resulting glaze. The desired type of glaze is one with a sufficiently low melting point, and whose stability vis-à-vis crystallization processes and phase precipitations is as high as possible. European Patent Application No. 1 168 546 mentions glazes that have a zinc oxide content of 10 to 30 molar percent to stabilize the glaze. The fluoride content is limited to a maximum of 1 molar percent, but the addition of fluorides is actually undesirable.

In contrast to the related art, an object of the present invention is to provide a lead-free glaze for spark plugs, one that has a low melting point in addition to high stability in the melted state, adheres well to the glazed surface in the cured state, and ensures high mechanical strength of the glazed components of the spark plug.

SUMMARY OF THE INVENTION

The object of the present invention is achieved preferably by coating the ceramic components of the spark plug with a glaze according to the present invention. Due to the stated content of coordinated amounts of fluoride and zinc oxide, the glaze has a low thermal expansion coefficient and a low melting temperature of less than 900° C., is particularly stable in the melt form, and has the advantage that it also forms a smooth surface in the cured state.

In addition, the production method, to which the present invention also relates, allows the thermal expansion coefficient of the glaze to be adjusted advantageously to the surface to be glazed so that, after it has cooled off, the glaze is under compressive stress, resulting in a high degree of mechanical strength of the glazed components. This property manifests itself, for example, when the glaze is applied to spark plug insulators, in high bending strength of the head of the glazed insulator.

The spark plug glaze may additionally contain barium and/or strontium; this improves the insulation characteristics and water resistance of the glaze considerably. The glaze may also contain alkali metal oxides that result in a further lowering of the melting point of the glaze. It is thereby of particular advantage for the potassium oxide content to be at least 1.5 times greater than the sodium oxide content.

The glazing is suitable in particular as surface coating for the spark plug insulator, because the glazing is highly resistant to environmental influences and has good insulating properties.

BRIEF DESCRIPTION OF THE DRAWINGS

The FIGURE shows an exemplary embodiment of a spark plug according to the present invention in section.

DETAILED DESCRIPTION

According to the present invention, spark plug 10 has a tube-shaped metal shell 13, in which a ceramic insulator 24 is positioned. End 27 of insulator 24 facing the combustion chamber encases a center electrode 22 and insulates it electrically from shell 13. It further includes a contact pin 20 that is used to transmit voltage to center electrode 22, as well as a connecting device 11 at its connection end 28. Connecting device 11 ensures that center electrode 22 is in electrical contact with an external voltage supply not depicted in the drawing. Its main components include a connecting bolt 12 which is also provided with a thread and a connecting nut 19 at its connection end. Between connecting device 11 and contact pin 20 is situated an erosion resistor 25 made of electrically conductive glass that mechanically anchors the spark plug components positioned inside insulator 24 and also provides a gas-proof seal against combustion pressure. An inner sealing seat 17 is positioned between insulator 24 and shell 13, sealing off the inside of the spark plug from the combustion chamber.

One or several mass electrodes 21 are welded to shell 13. The spark is produced between these and center electrode 22.

On its outside, shell 13 has a hexagonal profile 14 by means of which the spark plug can be screwed into an engine block. In addition, an outer sealing seat 16 is provided, sealing off the combustion chamber from the surrounding atmosphere. Thread 18 molded onto shell 13 is used to fasten the spark plug in the engine block.

Insulator 24 includes, at least on its outside facing the surrounding atmosphere, a glaze 26 on the basis of a lead-free borosilicate glass.

However, insulator 24 may also be glazed on other parts of its surface. In weight percent, the glaze has the following basic composition:

$SiO_2$ 37.0 to 46.0, preferably 37.0 to 44.0
$B_2O_3$ 12.0 to 28.0, preferably 17.5 to 23.0
$Al_2O_3$ 4.0 to 21.0, preferably 8.5 to 16.0
ZnO 6.0 to 11.4, preferably 7.8 to 11.4
$F^-$ 0.6 to 4, preferably 0.6 to 3.0
$Li_2O$ 1.5 to 4, preferably 1.9 to 3.5
$Na_2O$ 0.1 to 2.5, preferably 0.1 to 2.0
$K_2O$ 0.5 to 4.5, preferably 3.0 to 4.5
CaO 1.8 to 6, preferably 2.1 to 4.2
SrO 0.1 to 3.6, preferably 0.1 to 1.2
BaO 0.8 to 6.8, preferably 4.5 to 6.5

The characteristics of glazes having the basic composition stated were tested on the following glazes, which are to be considered exemplary embodiments. All figures represent weight percentages. The quantities of the individual element oxides refer to glazes after addition of the respective quantities of kaolin or bentonite. A varying amount of kaolin was added to two base glazes, 1 and 5, resulting in glazes 2 through 4 and 6 through 9, the first base glaze 1 having a larger zinc, calcium and strontium content, the second base glaze 5, however, containing more sodium oxide and potassium oxide than base glaze 1.

| | Sample | | | | | | | | |
|---|---|---|---|---|---|---|---|---|---|
| | 1 | 2 | 3 | 4 | 5 | 6 | 7 | 8 | 9 |
| Kaolin | 0 | 10 | 20 | 30 | 0 | 10 | 15 | 20 | 30 |
| Bentonite | 0.5 | 0.5 | 0.5 | 0.5 | 0.5 | 0.5 | 0.5 | 0.5 | 0.5 |
| $SiO_2$ | 38.4 | 39.9 | 41.4 | 43.0 | 38.2 | 39.1 | 39.6 | 40.0 | 41.0 |
| $B_2O_3$ | 24.6 | 22.4 | 20.2 | 17.9 | 25.2 | 22.7 | 21.5 | 20.2 | 17.7 |
| $Al_2O_3$ | 5.1 | 8.5 | 12.1 | 15.7 | 5.1 | 8.5 | 10.2 | 11.9 | 15.3 |
| ZnO | 12.1 | 11.0 | 9.9 | 8.8 | 11.3 | 10.2 | 9.6 | 9.1 | 7.9 |
| $F^-$ | 1.1 | 1. | 0.9 | 0.8 | 0.9 | 0.8 | 0.8 | 0.7 | 0.6 |
| $Li_2O$ | 2.7 | 2.4 | 2.2 | 1.9 | 2.9 | 2.6 | 2.5 | 2.3 | 2.0 |
| $Na_2O$ | 0.4 | 0.4 | 0.4 | 0.3 | 2.1 | 1.9 | 1.8 | 1.7 | 1.5 |
| $K_2O$ | 4.0 | 3.8 | 3.5 | 3.2 | 4.6 | 4.2 | 3.9 | 3.7 | 3.2 |
| CaO | 4.0 | 3.7 | 3.3 | 2.9 | 3.0 | 2.7 | 2.6 | 2.4 | 2.1 |
| SrO | 1.1 | 1.0 | 0.9 | 0.8 | 0.1 | 0.1 | 0.1 | 0.1 | 0.1 |
| BaO | 6.5 | 6.0 | 5.4 | 4.8 | 6.6 | 5.9 | 5.6 | 5.3 | 4.6 |
| TEC *10E6[1)] | 7.1 | 6.7 | 6.1 | 5.6 | 7.6 | — | 6.7 | — | — |
| HBS[2)] | 1725 | 1818 | 1804 | 1817 | 918 | 1209 | 1850 | 1834 | 1838 |
| TE[3)] | 454 | 446 | 444 | 437 | — | — | — | — | — |

[1)]Thermal expansion coefficient, expressed in 1/K, measured at 20 through 400° C.

[2)]Head bending strength, expressed as an average in newtons, measured according to DIN ISO 11565. The measurement is effected by fixing the spark plug to be tested into an appropriate testing block, using the maximum tightening torque prescribed by the applicable spark plug standard. A force is applied at a right angle to the insulator axis within 5 millimeters from the connection end of the spark plug, and it is gradually increased to the point of rupture. The force applied is taken as the value for the bending strength of the head.

[3)]Thermal expansion value, expressed as the temperature in ° C. at which the specific resistance of the glaze is 1 megohm * cm.

Based on the two base glazes it can be observed that the thermal expansion coefficient drops when the proportion of kaolin is greater than 10% by weight, with the head bending strength of the respective spark plug rising simultaneously. A kaolin content of more than 30% by weight does not result in any significant improvements of the characteristics of those glazes compared to glazes containing 30% by weight of kaolin.

The glaze is manufactured by mixing a glaze frit in powder form with kaolin or bentonite, also in powder form, with the kaolin or bentonite content, selected in such a way as to result in a thermal expansion coefficient of $<7*10^{-6}$ 1/K. What is meant here by kaolin is mainly a kaolinite-containing clay, wherein kaolinite represents any mineral aluminum hydroxysilicate. Bentonite is a clay substance that contains a mixed sodium-aluminum-magnesium hydroxy-silicate.

The raw materials in powder form are mixed with water or another solvent, with the addition of an organic binder, and then applied to insulator 24 to be glazed by means of spraying, rolling or immersion. The layer thickness of the glaze applied is preferably between 5 μm and 40 μm. To finish, insulator 24 is subjected to heat treatment at temperatures between 850° and 900° C., in which the insulator is fired and the raw components are transformed into the glaze.

What is claimed is:

1. A method for manufacturing a spark plug comprising:

producing a glaze, wherein the production of the glaze includes blending a ceramic base with at least one of Kaolin and bentonite in such a manner that a thermal expansion coefficient of a fired glaze is $<7 * 10^{-6}$ 1/K; and applying the glaze to ceramic components of the spark plug wherein the resulting spark plug has a head bending strength of at least 1800 Newtons.

2. the method according to claim 1, wherein the ceramic base is blended with up to at least one of (a) 5% by weight of bentonite and (b) 10% to 30% by weight kaolin.

3. The spark plug according to claim 1, further comprising melting the ceramic base at a temperature <900° C. after an addition of at least one of bentonite and kaolin.

* * * * *